United States Patent [19]

Vidas

[11] 4,247,283

[45] Jan. 27, 1981

[54] MUSICAL INSTRUMENT ADAPTED TO EMIT A CONTROLLED FLAME

[76] Inventor: Pat Vidas, 3778 Dunhill Rd., Wantagh, N.Y. 11793

[21] Appl. No.: 49,466

[22] Filed: Jun. 18, 1979

[51] Int. Cl.[3] ..... F23Q 2/32; A63J 17/00

[52] U.S. Cl. ..... 431/253; 431/1; 431/125; 84/388; 84/453; 84/464 R

[58] Field of Search ..... 431/1, 125, 252, 253; 84/387, 388, 453, 464, 464 A; 239/211, 289

[56] References Cited

U.S. PATENT DOCUMENTS

| | | | |
|---|---|---|---|
| 392,192 | 11/1888 | Ellis et al. | 431/125 |
| 1,602,710 | 10/1926 | Saunders | 84/464 A X |
| 2,198,234 | 4/1940 | Stratton | 431/125 |
| 3,267,700 | 8/1966 | Kommer et al. | 431/125 X |
| 3,565,337 | 2/1971 | Ditto | 431/125 X |

FOREIGN PATENT DOCUMENTS

| | | | |
|---|---|---|---|
| 60212 | 7/1913 | Austria | 431/125 |
| 592720 | 2/1934 | Fed. Rep. of Germany | 431/125 |
| 843931 | 8/1960 | United Kingdom | 431/125 |

*Primary Examiner*—Robert S. Ward, Jr.
*Attorney, Agent, or Firm*—Arthur L. Plevy

[57] ABSTRACT

A flaming trumpet or a musical instrument which emits a flame under the control of the musician playing the instrument. The intensity and duration of the flame are controlled by the musician activating a control valve which controls the amount of gas emanating from a cartridge mounted on the instrument. The gas is directed through tubing so that it emanates from the flared end of the instrument and is ignited by means of a spark mechanism which is operated by the musician.

10 Claims, 3 Drawing Figures

GAS CARTRIDGE 11
GAS CARTRIDGE
10
11
12
14
15
16
17
18
20
21
22
24
25
26
28
30
31
32
33
40
45
50
52

MUSICAL INSTRUMENT ADAPTED TO EMIT A CONTROLLED FLAME

BACKGROUND OF INVENTION

This invention relates to a muscial instrument and more particularly to a trumpet which will emit a flame of a predetermined length and duration under the control of the musician.

As can be ascertained, many performances by musicians or artists are accompanied by special effects in order to further enhance the quality of the presentation and to entertain the audience. There are many modern groups who employ substantial visual and sound effects in conjunction with their performances and have gained widespread popularity based on the utilization of such additional effects together with the musical format.

In view of such considerations, the applicant herein has conceived of a trumpet which will emit a flame out of the bell of the trumpet whereby the flame is safely controlled by the musician. The apparatus offers a novel and sensational visual effect to an audience when the instrument is being played by a skilled practitioner. In terms of appreciation and audience reaction, the instrument creates a unique visual effect. The nature of the instrument is such that the trumpet can be played at the same time the flame is being emitted. The length and duration of the flame are completely under control of the musician, who therefore based on the composition being played, can control the flame according to the music. As will be explained, the instrument emits flames on the command of the musician and is absolutely safe to use and reliable in operation.

The foregoing description is directed at the use of apparatus for emitting a flame under the control of a musician. The description and drawings particularly depict a trumpet. In any event, it is understood that the concept would apply equally to many wind instruments of a similar nature and structure to the trumpet and will provide the requisite visual effects as above indicated.

BRIEF DESCRIPTION OF THE PREFERRED EMBODIMENT

A combination adapted for use with a wind instrument of the type having a flared bell section for emitting sounds created by air pressure variations, said combination comprising a source of pressurized ignitable gas adapted to be mounted on said instrument, controllable valve means coupled to said source and operative to regulate the amount of gas emitted, a tube coupled to said valve for directing said emitted gas towards the flared end of said instrument, and means positioned on said instrument adjacent said tube at said flared end of said instrument, for igniting said gas, whereby a flame emanates from said instrument according to the operation of said valve means.

DETAILED DESCRIPTION OF THE INVENTION

Figures 1, 2, 3:
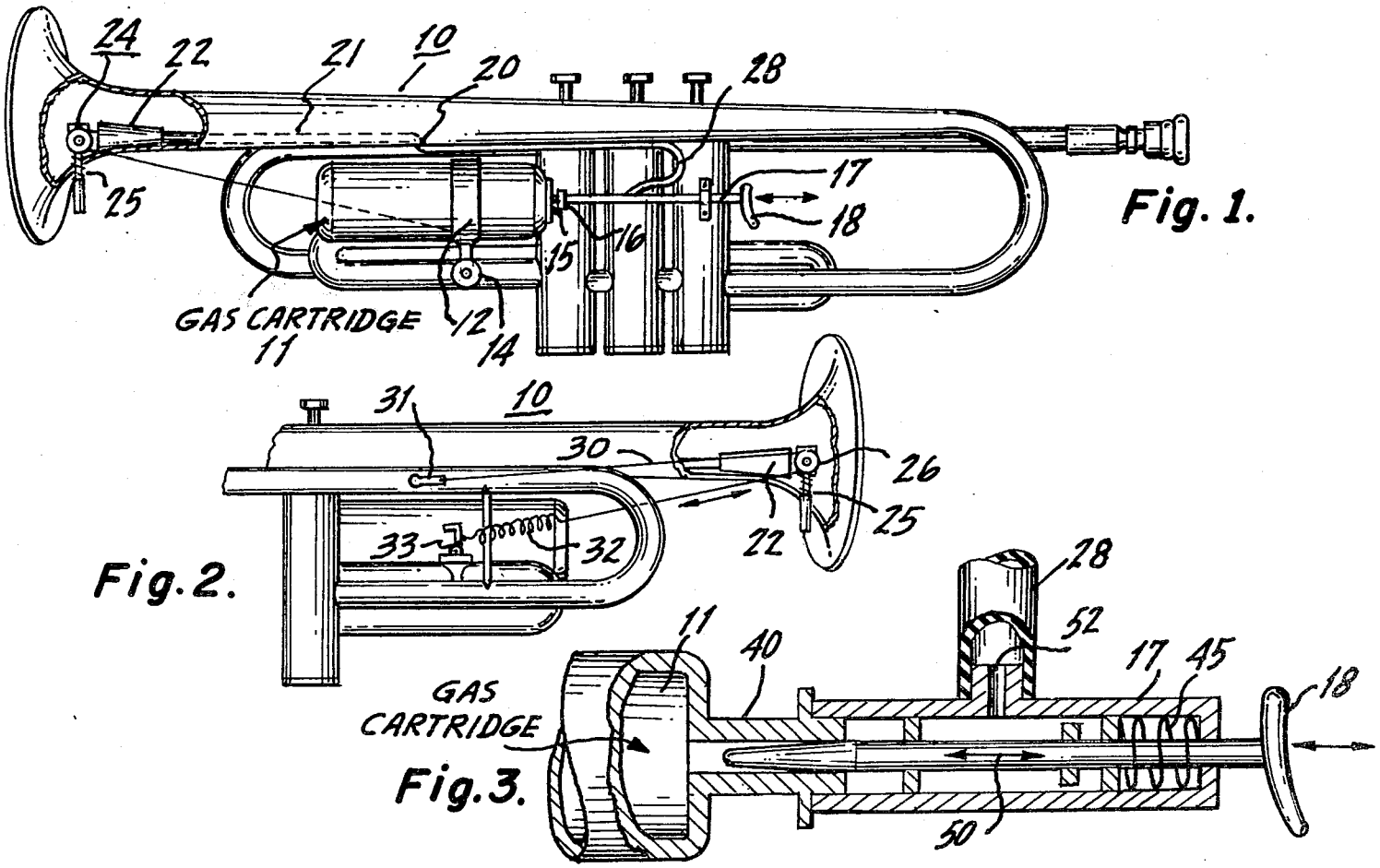
FIG. 1 is a side view partially in cross section showing a trumpet having a flame emitting mechanism according to this invention.
FIG. 2 is a diagrammatic view showing a spark control employed in the apparatus for igniting a stream of gas.
FIG. 3 is a cross sectional view of one end of a valve assembly which can be used in this invention.

Referring to FIG. 1, there is shown a partial cross sectional view of a trumpet employing the flame emitting apparatus according to this invention. It is indicated that the format of a conventional trumpet is well known and the apparatus to be described can be conveniently employed on any existing trumpet.

Shown in FIG. 1 is a conventional type of trumpet 10. Mounted on the bracket of the trumpet is a butane cartridge 11. The cartridge 11 is secured to the body of the trumpet by means of a suitable ring clamp or other clamping arrangement. Essentially, the clamp surrounds the cartridge and holds it in position by means of a screw 14 or another retaining device. The butane cartridge 11 is of a conventional type as are commercially available for refilling butane cigarette lighters. The cartridge possesses a front end 15 which has an aperture for emitting fumes of the butane gas.

Coupled to the cartridge is a valve 16. The valve 16 may be of many known configurations and essentially consists of a pin which is spring biased. As the pin is retracted from the aperture in the butane cartridge, it allows gas to escape. When the pin is within the aperture, the flow of gas is inhibited.

Coupled to the valve is a valve control member 17. The valve control member consists of an elongated slidable arm which has a hollow interior. Coupled to the arm is a finger control portion 18. In this manner, the musician, by depressing member 18, can move member 17 and hence, the valve 16 to thereby allow gas to be emitted from the cartridge 11 under the control and command of the musician. Essentially, the member 17 is a cylindrical member.

Coupled to member 17 via an aperture therein is a length of flexible tubing 28. The flexible tubing may be fabricated from a suitable plastic or metal is approximately $\frac{1}{8}$" in diameter. The tubing is directed beneath the bell of the trumpet and then enters the bell through an aperture 20 formed in the bottom side of the trumpet. The tubing then continues within the bell of the trumpet towards the opened flared end. Coupled to the tubing is an outer flare section 22 to enable the gas fumes to diverge at the output of the device to obtain a relatively large flame pattern.

Located adjacent the end section 22 is a flint and spark wheel section 24. As is well known, the rotation of a spark wheel in conjunction with a flint will produce a spark. The spark is of a sufficient magnitude and intensity to ignite the gas and thus enable a flame to be produced. Essentially, the flint is positioned beneath the spark wheel 24 by means of a spring loaded flint cylinder 25. In this manner, the spring associated with member 25 urges the flint into contact with the spark wheel.

Referring to FIG. 2, there is shown the spark wheel 26. The spark wheel 26 is rotatably mounted within the flare of the trumpet. The spark wheel 26 has a peripheral groove about which a cord or wire 30 is directed. One end of the wire 30 is permanently affixed or clamped to the body of the trumpet by means of a suitable clamping device 31.

The wire 30 is directed about the spark wheel 26 and is coupled via a spring 32 to a switch or plunger member 33 which is mounted on a suitable bracket of the trumpet. As can be seen from FIG. 2, as the switch 33 is depressed, the spring stretches to hence allow the spark wheel 25 to rotate. Upon rotation of the spark wheel 25, the flint which is in contact with the spark wheel emits a spark. If the musician activated the valve control 17, a flame would emanate from the flared end of the trumpet and thus producing a flaming trumpet effect.

Referring to FIG. 3, there is shown a simple cross-sectional view of a controllable valve assembly which will operate as 17 and 18 depicted in FIG. 1. Essentially, the butane cartridge 11 has an output end or aperture 40 through which gas is emitted. Tubular member 17 surrounds the aperture 40 and as indicated, is hollow.

A slidable pin 45 is coupled to the control button 18. The pin 45 is slidably mounted within the housing 17 and hence, can move in the direction of the arrow 50. Hence, as one moves member 18, one can slide the tapered end of the pin in and out of the aperture 40 thus controlling the amount of gas which will be injected into the hollow confines of member 17. An outlet port 52 is shown and is coupled to the flexible tubing such as 18 of FIG. 1. In this manner, the gas stream is controlled by the movement of the pin 45 via the control surface 18.

There are, of course, many other valves and control assemblies which would be suitable for operation of this device and any such assembly can be employed.

As one can ascertain from the FIGS., the acoustic qualities of the trumpet are not in any manner effected and the musician can play the trumpet while maintaining control of the valve 18 to assure that the flame will continue to be emitted at the output of the trumpet. Depending upon the distance the musician moves the member 17, he can increase or decrease the amount of gas flow and hence, control the length and duration of the flame. In this manner, the visual effects provided by the above described instrument are unique and are extremely pleasing and entertaining to the audience.

While the above described apparatus employs a spark wheel and a flint member to ignite the gas, it is understood that any other type of device such as a piezoelectric device or a heating coil operated from a battery may be employed to ignite the gas at the output section 22 of the apparatus. In this manner, the trumpet or musical instrument will emit an extended flame while further enabling the musician to continue to play the instrument. The musician can control the length and extent of the flame by suitable adjustment of the valve control member 17 and hence, the flame may be modulated or varied by the musician according to the musical content of the particular composition.

The instrument as described above has, in fact, been employed in a trumpet. The bell of the trumpet will heat to some degree during operation of the flame mechanism, but based on the composition of the trumpet and the arrangement of the apparatus described, does not produce any appreciable heat back at the valve section. This is where the trumpet player's hands are and due to the fact that he can control the apparatus, the flame can be turned on and off at the will of the musician.

The above described combination of apparatus produces an extremely pleasant visual effect and has been widely received and appreciated by audiences and the musical world in general.

It is understood that many modifications and versions will be appreciated by those skilled in the art and all such alternatives are deemed to be encompassed within the breadth and scope of the claims appended hereto.

I claim:

1. A combination adapted for use with a wind instrument of the type having a flared bell section for emitting

2. A combination according to claim 1 wherein said wind instrument is a trumpet.

3. A combination according to claim 2 wherein said source of pressurized gas is a butane cartridge mounted on said trumpet.

4. A combination according to claim 2 wherein said tube comprises a flexible tube coupled to said controllable valve means and extending through an aperture in the body of said trumpet towards said flared end, said tube coupled to a flared output portion for diverging said gas at the output of said instrument.

5. The combination according to claim 1 wherein said means for igniting said gas comprises selectively operated ignition means for producing a spark capable of igniting said gas.

6. The combination according to claim 5 wherein said selectively operated ignition means includes a spark wheel rotatably mounted on said instrument near said flared end, a flint means coacting with said spark wheel for providing a spark when said wheel is rotated, and selectively operated means mounted on said instrument and coupled to said wheel to rotate the same when said means are selected.

7. The combination according to claim 1 wherein said controllable valve means comprises a pin adapted for insertion into a gas emitting aperture associated with said source, and means coupled to said pin for varying the depth of insertion into said aperture to thereby control the amount of gas emitted.

8. The combination according to claim 2 wherein said tube is directed into the hollow of said trumpet with the tube terminating in relatively close proximity to said flared end of said trumpet whereby said flame as emitted emanates from the flared bell end of said trumpet.

9. The combination according to claim 6 wherein said means coupled to said wheel includes a wire directed about the periphery of said wheel and operative to rotate said wheel when said wire is moved, and means coupled to said wire for moving the same.

10. The combination according to claim 7 wherein said pin is tapered to thereby control the amount of gas emitted strictly according to the depth of insertion as manifested by said taper.

* * * * *

UNITED STATES PATENT OFFICE

CERTIFICATE OF CORRECTION

Patent No. 4,247,283 Dated January 27, 1981

Inventor(s) PAT VIDAS

It is certified that error appears in the above-identified patent and that said Letters Patent are hereby corrected as shown below:

Col. 4, line 13 - after "emitting", please insert: ---sounds created by air pressure variations, said combination comprising:

a) a source of pressurized ignitable gas adapted to be mounted on said instrument, b) controllable valve means coupled to said source and operative to regulate the amount of gas emitted, c) a tube coupled to said valve for directing said emitted gas towards the flared end of said instrument, and d) means positioned on said instrument adjacent said tube at said flared end of said instrument for igniting said gas, whereby a flame emanates from said instrument according to the operation of said valve means.---

Signed and Sealed this

Fourteenth Day of April 1981

[SEAL]

Attest:

RENE D. TEGTMEYER

Attesting Officer

Acting Commissioner of Patents and Trademarks